US008348603B2

(12) United States Patent
Garcia-Crespo et al.

(10) Patent No.: US 8,348,603 B2
(45) Date of Patent: Jan. 8, 2013

(54) GAS TURBINE INNER FLOWPATH COVERPIECE

(75) Inventors: Andres Jose Garcia-Crespo, Greenville, SC (US); Bradley Taylor Boyer, Greenville, SC (US); John Wesley Harris, Jr., Taylors, SC (US); Brian Denver Potter, Greer, SC (US); Ian David Wilson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 825 days.

(21) Appl. No.: 12/417,129

(22) Filed: Apr. 2, 2009

(65) Prior Publication Data

US 2010/0254805 A1 Oct. 7, 2010

(51) Int. Cl.
*F01D 11/08* (2006.01)

(52) U.S. Cl. ..... 415/173.7; 415/174.5; 277/402

(58) Field of Classification Search ..... 415/173.1, 415/173.7, 173.4, 174.5; 277/402, 403; 416/218
See application file for complete search history.

(56) References Cited

U.S. PATENT DOCUMENTS 4,521,496 A * 6/1985 Sara ..... 428/551
4,884,950 A * 12/1989 Brodell et al. ..... 416/174
5,217,348 A 6/1993 Rup, Jr. et al.
5,630,703 A * 5/1997 Hendley et al. ..... 416/95

* cited by examiner

*Primary Examiner* — Caridad Everhart
(74) *Attorney, Agent, or Firm* — Cantor Colburn LLP

(57) ABSTRACT

A gas turbine inner flow path cover piece for a gas turbine a first turbine wheel and a second turbine wheel is provided is provided. The gas turbine inner flow path cover piece can include a main body having an first surface and a second surface, side pieces disposed on the first surface of the main body and mating pairs disposed on the second surface of the main body.

12 Claims, 4 Drawing Sheets

FIG. 5

GAS TURBINE INNER FLOWPATH COVERPIECE

BACKGROUND OF THE INVENTION

The subject matter disclosed herein relates to gas turbines, and more particularly to a gas turbine inner flow path cover piece.

FIG. 1 illustrates a prior art gas turbine configuration 100. In typical hot gas section designs, such as the configuration 100, turbine wheels 105, 110, including airfoil slots 101, are not designed to withstand the high temperatures of the combustion gas within the turbine. Gaps between stationary and rotating parts could cause this gas to reach the wheel materials and cause them to require excess maintenance. As such, cooler air is introduced into a cavity 115 in between wheels 105, 110 that pressurizes the cavity 115, preventing hot air from leaking into the cavity 115. A diaphragm 121 is typically included to fill the cavity 115. The process of introducing the cooler air is referred to as cavity purging. Cavity purging implements pressurized air that leaks into the hot gas path in the gas turbine, thereby reducing the efficiency of the gas turbine.

Current solutions implement direct purging of air into the cavities between the rotor wheels. Other solutions implement an intermediate wheel that carries a platform to seal the hot gas path away from the wheel surfaces. Current solutions can incur a penalty in engine performance due to the parasitic use of compressor air to purge the cavities as to avoid ingestion. Also, the cavities eject air perpendicular to the main flow path, incurring mixing losses before the gas enters the blade or nozzle row.

BRIEF DESCRIPTION OF THE INVENTION

According to one aspect of the invention, an apparatus in a gas turbine having a first turbine wheel and a second turbine wheel is provided. The apparatus includes a main body having a first surface and a second surface, side pieces disposed on the first surface of the main body and mating pairs disposed on the second surface of the main body.

According to another aspect of the invention, a gas turbine assembly is provided. The gas turbine assembly includes a first turbine wheel, a second turbine wheel and a gas turbine inner flow path cover piece disposed between the first turbine wheel and the second turbine wheel.

According to yet another aspect of the invention, a gas turbine is provided. The gas turbine includes a first turbine wheel, a second turbine wheel, a hot section turbine nozzle disposed between the first and second turbine wheels and a gas turbine inner flow path cover piece disposed between the first turbine wheel and the second turbine wheel.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
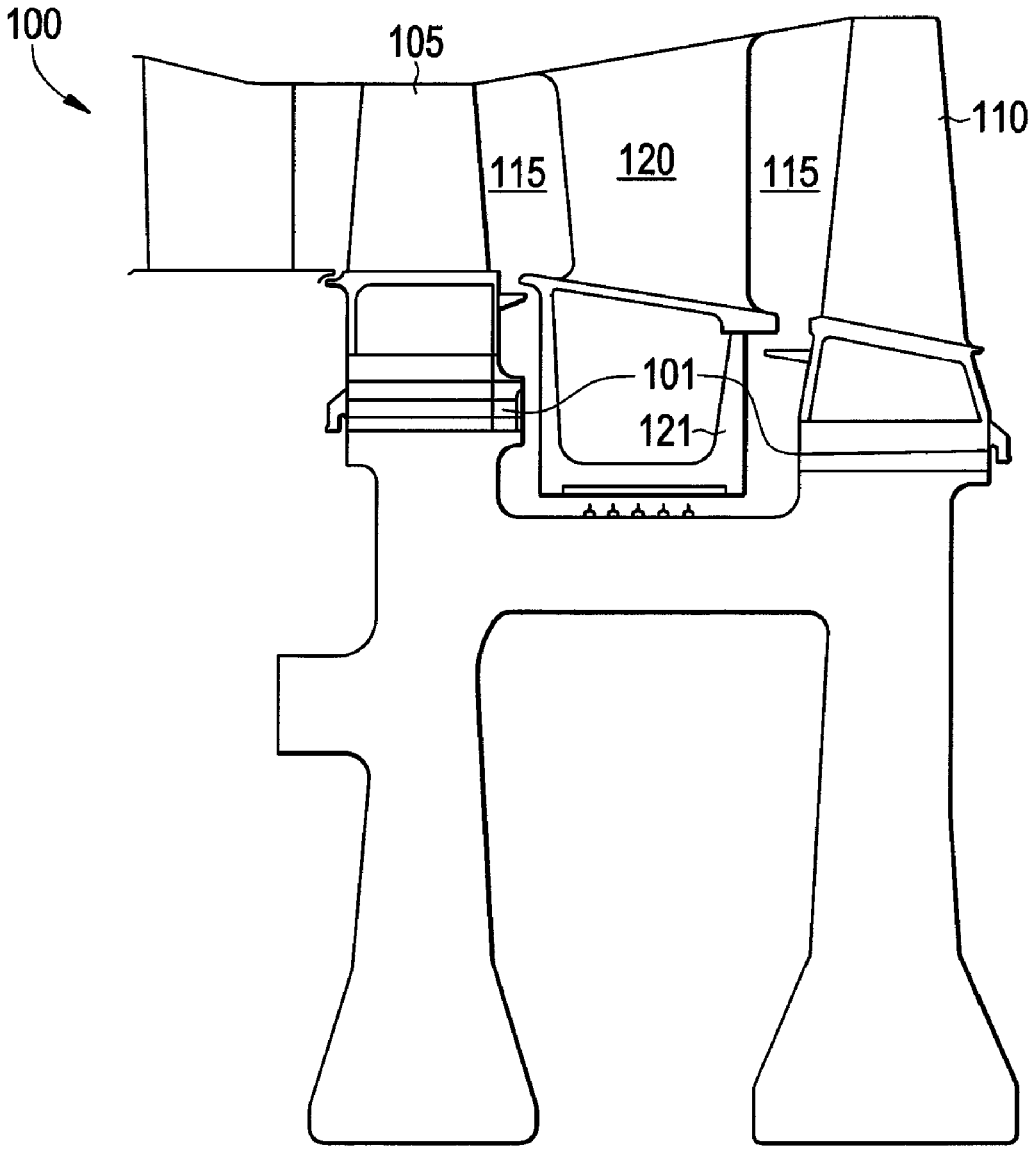
FIG. 1 PRIOR ART
FIG. 1 illustrates a side view prior art gas turbine configuration.
Figure 2:
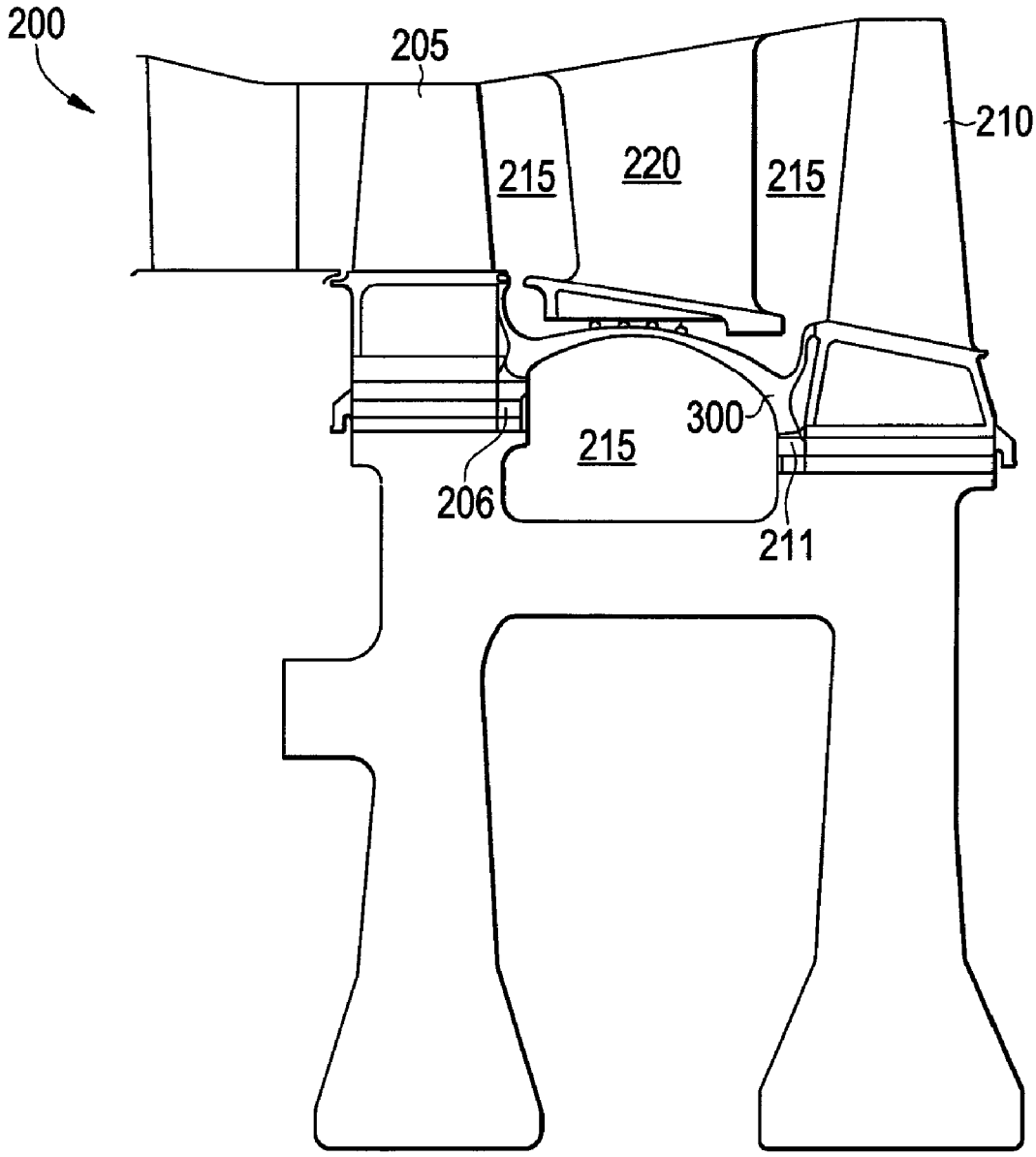
FIG. 2 illustrates a side view gas turbine configuration including an exemplary gas turbine inner flow path cover piece.

FIG. 2 illustrates a gas turbine configuration 200 including an exemplary gas turbine inner flow path cover piece 300. In exemplary embodiments, the configuration 200 includes adjacent turbine wheels 205, 210 having a cavity 215 disposed between the turbine wheels 205, 210. The configuration 200 further includes the gas turbine inner flow path cover piece 300 disposed between the turbine wheels 205, 210. It is appreciated that in exemplary embodiments, the conventional diaphragm (see the diaphragm 121 in FIG. 1) is removed. The configuration 200 further includes a hot section turbine nozzle 220 that provides the cool air for cavity purging as described herein. With the disposition of the gas turbine inner flow path cover piece 300 between the adjacent turbine wheels 205, 210, the aforementioned cavity purging can be greatly reduced because there is a reduced upper cavity 225 directly exposed to the hot gas path temperatures. A lower cavity 215 is not exposed to the hot air flow of the gas turbine because it is shielded by the gas turbine inner flow path cover piece 300. Since the hot section turbine nozzle 220 only purges the upper cavity 225, less cavity purging and thus less cool air is required. Since no heavy cavity purge is required, aero losses stemming from the purge flows are greatly reduced resulting in a vast improvement in efficiency. It is also appreciated that diaphragms typically implemented on the hot section turbine nozzle 220 are no longer implemented.

Figure 3:
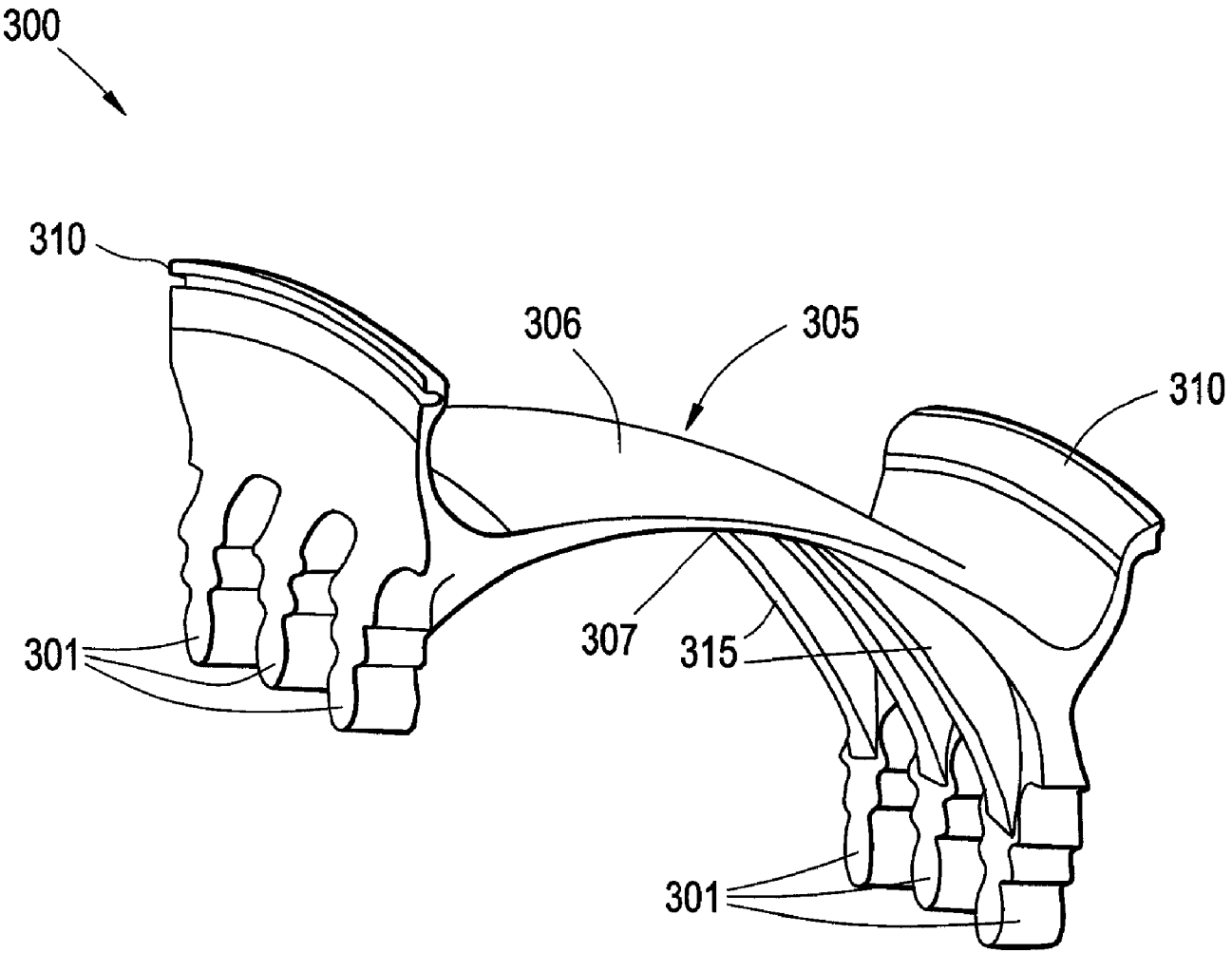
FIG. 3 illustrates a side perspective view of an exemplary gas turbine inner flow path cover piece.

In exemplary embodiments, the turbine wheels 205, 210 each include at least one of male and female dovetail mating pairs 206, 211 (airfoil slots). As illustrated, the turbine wheels 205, 210 include female dovetail mating pairs 206, 211. FIG. 3 illustrates a side perspective view of an exemplary gas turbine inner flow path cover piece 300. FIG. 3 illustrates that the gas turbine inner flow path cover piece 300 includes corresponding male dovetail mating pairs 301. In exemplary embodiments, the dove-tail mating pairs 301 couple with the dove-tail mating pairs 206, 211 on respective turbine wheels 205, 210 to affix the gas turbine inner flow path cover piece 300 between the turbine wheels 205, 210. In exemplary embodiments, the gas turbine inner flow path cover piece 300 is slid into place axially next to the adjoining turbine wheels 205, 210. In exemplary embodiments, the dovetail mating pairs 301 are disposed on a second surface 307 of the main body 305.

In exemplary embodiments, the gas turbine inner flow path cover piece 300 includes a main body 305 having an first (upper) surface 306 with a pre-defined contour matching that contour of a desired flow path within the upper cavity 225. In exemplary embodiments, the gas turbine inner flow path cover piece 300 can have any number of sealing mechanisms facing such flow path for mating with any sealing structure in order to prevent combustion gases from circumventing the stationary vane. In exemplary embodiments, a number of gas turbine inner flow path cover pieces 300 can be implemented to form a ring creating an annulus (upper cavity 225) between the hot section turbine nozzle 220 and the first surface 306 of the gas turbine inner flow path cover piece 300. In exemplary embodiments, the gas turbine inner flow path cover piece 300 can further include side pieces 310 configured to contact the turbine wheels 205, 210 when the gas turbine inner flow path cover piece 300 is affixed between the turbine wheels 205, 210. The side pieces 310 are contiguous with the first surface 306 and can be perpendicular to the first surface 306. In exemplary embodiments, the side pieces 310 can be perpendicular to the second (lower) surface 307 and further can be co-planar with the dove-tail mating pairs 301. In exemplary embodiments, the side pieces 310 are configured to deform at increased speeds of the turbine wheels 205, 210 forming a seal between the side pieces 310 and a blade section of the turbine wheels 205, 210.

Figure 4:
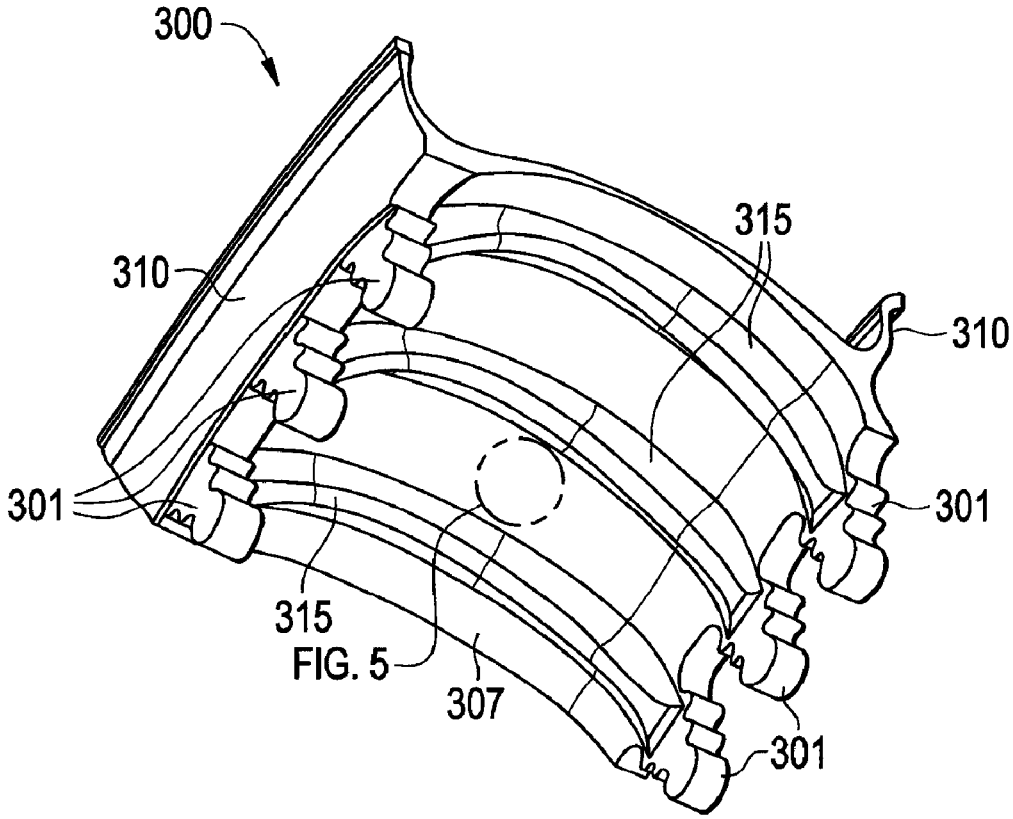
FIG. 4 illustrates a bottom view of the gas turbine inner flow path cover piece.
Figure 5:
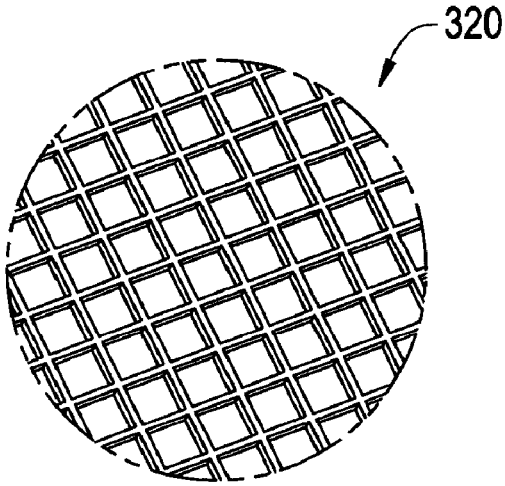
FIG. 5 illustrates an isogrid pattern on the lower surface of the gas turbine inner flow path cover piece.

In exemplary embodiments, the gas turbine inner flow path cover piece 300 can further include structural supports 315 disposed on the second surface 307 of the main body 305. The structural supports 315 are configured to provide a desired stiffness of the gas turbine inner flow path cover piece 300 in the radial direction. It is appreciated that the gas turbine inner flow path cover piece 300 can be fabricated using composite materials, frame techniques, plain material or any combination of other structural treatments to assure the desired stiffness in the radial direction. For example, in exemplary embodiments, the second surface 307 can include an isogrid pattern providing an isotropic support along the second surface 307. FIG. 4 illustrates a bottom view of the gas turbine inner flow path cover piece 300. FIG. 5 illustrates an isogrid pattern 320 on the lower surface of the gas turbine inner flow path cover piece 300. The isogrid pattern 320 maintains stiffness of the gas turbine inner flow path cover piece 300 while reducing the overall weight of the gas turbine inner flow path cover piece 300. As such the turbine wheels 205, 210 experience decreased weight from the gas turbine inner flow path cover piece 300. As described above, the side pieces 310 are configured to deform during rotation, but the main body 305 having the isogrid pattern 320 on the lower surface can maintain stiffness and lower weight. As such, load requirements on the dove-tail mating pairs 301 coupled with the dove-tail mating pairs 206, 211 on respective turbine wheels 205, 210, are reduced.

The exemplary embodiments described herein eliminate or greatly reduce the cavity purges as there is no wheel cavity directly exposed to the hot gas path temperatures. Also, as no heavy purge is required, aero losses stemming from the purge flows used are greatly reduced resulting in a vast improvement in efficiency. Since the dovetail pairs 206, 211 on the turbine wheels 205, 210 are covered, cost advantages are realized because the turbine length is reduced. The presence of the gas turbine inner flow path cover piece 300 further prevents inter-stage leakage. Furthermore, the presence of the gas turbine inner flow path cover piece 300 can result in smaller bucket shanks leads to cost advantage. The complete elimination of diaphragms on the hot section turbine nozzle 220 also leads to cost advantage, which can lead to a higher hot section turbine nozzle life due to reduced plug load leads to cost advantage due to a reduced area subject to a differential pressure under the nozzle sections in comparison with convention configurations.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. In a gas turbine having a first turbine wheel and a second turbine wheel, the first and second turbine wheels having airfoil slots, an apparatus disposed between the first and second turbine wheels, the apparatus comprising:

a main body having a first surface and a second surface;

side pieces disposed on the first surface of the main body;

structural supports disposed on the second surface of the main body; and first mating dovetails disposed on the second surface of the main body adjacent the structural supports, and configured to mate with second mating dovetails disposed adjacent to at least one of the first turbine wheel and the second turbine wheel, wherein the side pieces are contiguous with and perpendicular to the first and second surfaces, and co-planar with the first and second mating dovetails.

2. The apparatus as claimed in claim 1 wherein the first surface includes a per-defined contour to match a flow path of hot air within the gas turbine.

3. The apparatus as claimed in claim 1 wherein the side pieces are configured to contact the first and second turbine wheels, and further configured to deform under a rotational pull of at least one of the first and second turbine wheels thereby creating a seal against a surface of at least one of the first and second turbine wheels.

4. The apparatus as claimed in claim 1 further comprising an isogrid pattern on at least one of the first and second surfaces.

5. A gas turbine assembly, comprising:

a first turbine wheel;

a second turbine wheel; and a gas turbine inner flow path cover piece disposed between the first turbine wheel and the second turbine wheel, and including:

a main body having a first surface and a second surface;

structural supports disposed on the second surface of the main body;

side pieces disposed on the first surface of the main body; and first mating dovetails disposed on the second surface of the main body adjacent the structural supports, and configured to mate with second mating dovetails disposed adjacent to at least one of the first turbine wheel and the second turbine wheel, wherein the side pieces are contiguous with and perpendicular to the first and second surfaces, and co-planar with the first and second mating dovetails.

6. The assembly as claimed in claim 5 further comprising an isogrid pattern on at least one of the first and second surfaces.

7. A gas turbine, comprising:

a first turbine wheel;

a second turbine wheel;

a hot section turbine nozzle disposed between the first and second turbine wheels; and a gas turbine inner flow path cover piece disposed between the first turbine wheel and the second turbine wheel, and including a main body having a first surface and a second surface;

structural supports disposed on the second surface of the main body;

side pieces disposed on the first surface of the main body; and first mating dovetails disposed on the second surface of the main body adjacent the structural supports, and configured to mate with second mating dovetails disposed adjacent to at least one of the first turbine wheel and the second turbine wheel, wherein side pieces are contiguous with and perpendicular to the first and second surfaces, and co-planar with the first and second mating dovetails.

8. The gas turbine as claimed in claim 7 wherein the first surface includes a per-defined contour to match a flow path of hot air within the gas turbine.

9. The gas turbine as claimed in claim 7 wherein the side pieces are configured to contact the first and second turbine wheels.

10. The gas turbine as claimed in claim 7 further comprising an isogrid pattern on at least one of the first and second surfaces.

11. The gas turbine as claimed in claim 7 wherein the gas turbine inner flow path cover piece is disposed adjacent the hot section turbine nozzle thereby forming an upper cavity between the first and second gas turbine wheels.

12. The gas turbine as claimed in claim 11 wherein the gas turbine inner flow path cover piece forms a cavity between the first turbine wheel and the second turbine wheel.

* * * * *